US008847709B2

(12) United States Patent
Tiihonen

(10) Patent No.: US 8,847,709 B2
(45) Date of Patent: Sep. 30, 2014

(54) RESONATOR FILTER

(75) Inventor: Markku Tiihonen, Kempele (FI)

(73) Assignee: Powerwave Technologies S.a.r.l., Luxembourg (LU)

( * ) Notice: Subject to any disclaimer, the term of this patent is extended or adjusted under 35 U.S.C. 154(b) by 637 days.

(21) Appl. No.: 13/163,530

(22) Filed: Jun. 17, 2011

(65) Prior Publication Data

US 2012/0007697 A1 Jan. 12, 2012

(30) Foreign Application Priority Data

Jul. 7, 2010 (FI) ..... 20105772

(51) Int. Cl.

| | |
|---|---|
| ***H01P 1/201*** | (2006.01) |
| ***H01P 7/10*** | (2006.01) |
| ***H01P 1/202*** | (2006.01) |
| ***H01P 1/208*** | (2006.01) |
| *H01P 1/205* | (2006.01) |

(52) U.S. Cl.

CPC ..... *H01P 1/2084* (2013.01); *H01P 7/10* (2013.01); *H01P 1/2053* (2013.01)

USPC ..... 333/202; 333/235; 333/207

(58) Field of Classification Search

CPC ..... H01P 1/2084; H01P 7/10

USPC ..... 333/202, 208, 212, 219.1, 232, 233

See application file for complete search history.

(56) References Cited

U.S. PATENT DOCUMENTS

| | | | | |
|---|---|---|---|---|
| 4,730,174 | A * | 3/1988 | Nishikawa et al. | 333/224 |
| 5,764,115 | A * | 6/1998 | Hattori et al. | 333/202 |
| 6,384,699 | B1 | 5/2002 | Henningsson et al. | |
| 7,463,121 | B2 * | 12/2008 | D'Ostilio | 333/223 |
| 2007/0139142 | A1 | 6/2007 | Li et al. | |
| 2009/0280991 | A1 | 11/2009 | Yamanaka et al. | |
| 2011/0102112 | A1 * | 5/2011 | Reddy et al. | 333/235 |

FOREIGN PATENT DOCUMENTS

EP 0986126 A1 6/2007

(Continued)

OTHER PUBLICATIONS

Finland Search Report for Application No. 20105772 dated Dec. 30, 2010.

(Continued)

*Primary Examiner* — Benny Lee
*Assistant Examiner* — Gerald Stevens
(74) *Attorney, Agent, or Firm* — Caseiro Burke LLC; Chris A. Caseiro

(57) ABSTRACT

A tuneable resonator filter consisting of cavity resonators. In the partition wall separating the successive resonators on the transmission path of a resonator filter there is a coupling opening (CPO) with a typically constant width. The coupling strength between the resonators is adjusted by a tuning element which is supported to the partition wall on the opposite sides of the coupling opening so that it can be moved. The tuning element is conductive and grounded so that the impedance between its ends and the partition wall is low. For moving the tuning element, it is linked by a dielectric rod to an electrically controllable actuator being located on the filter lid. By means of the tuning mechanism the bandwidth of a filter can be set automatically.

8 Claims, 4 Drawing Sheets

(56) References Cited

FOREIGN PATENT DOCUMENTS

| | | | |
|---|---|---|---|
| EP | 1895615 | A1 | 3/2008 |
| JP | 2004200892 | A | 7/2004 |
| JP | 2006191379 | A | 7/2006 |
| JP | 2007312440 | A | 11/2007 |
| WO | 97/31402 | A1 | 8/1997 |
| WO | 9731402 | A1 | 8/1997 |
| WO | 99/36982 | A2 | 7/1999 |

OTHER PUBLICATIONS

Extended European Search Report dated Aug. 31, 2011 from European Application No. 11170340.1.
Office Action dated Aug. 16, 2012 from European Application No. 11170340.1.

* cited by examiner

RESONATOR FILTER

BACKGROUND OF THE INVENTION

The invention relates to a filter consisting of cavity resonators, in which filter the couplings between the resonators can be adjusted. A typical application of the invention is an antenna filter in a base station of a cellular network.

In order that the frequency response of a bandpass filter complies with the requirements, its passband must on the one hand be located at the right place on the frequency axis and on the other hand be of the right width. In a resonator filter this requires that the resonance frequency, or natural frequency, of each resonator is right and in addition the strength of the couplings between the resonators is right. In serial production, a filter consisting of cavity resonators is naturally formed by mechanical dimensions so that these requirements are realized as fully as possible. In practice, the manufacturing process is not precise enough, for which reason the filter must be tuned before adoption.

In tuning, both the natural frequency of the resonators and the strength of the couplings between the resonators are adjusted. The latter adjustment affects the bandwidth of the filter. Both adjustments can be implemented in many ways. The conventional way is to provide the structure with metallic tuning screws so that these extend into the resonator cavities and/or into the coupling openings between the resonators. When turning e.g. a tuning screw for coupling adjustment deeper to a coupling opening, which is located in the upper part of the filter, the strength of the coupling between the resonators in question weakens, which has the effect of narrowing the band. A flaw of the use of the tuning screws is that the junction between them and the surrounding metal can cause harmful passive intermodulation when the filter is in use. In addition, the electric contact in the threads can degrade in the course of time, which results in change in the tuning and increase in the losses of the resonators.

The strength of the coupling between two resonators can be adjusted also by means of a bendable tuning element arranged close to the coupling opening. The flaw of such a solution is that in a multiresonator filter the tuning elements may possibly have to be bent in several steps in order to achieve the desired frequency response. The lid of the filter has to be opened and closed for each adjustment, for which reason the tuning is time-consuming and relatively expensive.

FIGS. 1*a* and *b* present a way to adjust the strength of the couplings between the resonators of a filter, known from the publication U.S. Pat. No. 5,805,033. The filter comprises a conductive housing formed by a bottom 101, outer walls 104, and a lid 105, the space of which housing is divided into resonator cavities by conductive partition walls 112*a-b*. Two resonators 110, 120 of the filter are seen in FIG. 1*a* from above with the lid removed, and FIG. 1*b* shows the cross section of the filter at the partition wall of the resonators in question.

In the middle of each resonator cavity there is a cylindrical dielectric object for decreasing the size of the resonator, such as the dielectric object 111 of the first resonator 110 and the dielectric object 121 of the second resonator 120. The bases of the cylinder are parallel with the bottom 101 and lid 105 of the filter. The dielectric objects have been dimensioned so that a $TE_{01}$ waveform (Transverse Electric wave) is excited in them at the use frequencies of the filter. Thus, the resonators are half-wave cavity resonators by type.

To implement the coupling between the resonators 110 and 120 there is an opening in their partition wall 112*a-b*, which opening extends from the lid to the bottom and narrows towards the bottom. To adjust the strength of the coupling there is a tuning element 115 in the coupling opening, which is a round metallic plate parallel with the lid 105. The plate has been fastened to the lid through a threading rod which extends outside the filter housing. When the threading rod is turned, the tuning element 115 moves vertically and changes the strength of the coupling between the resonators. In the figure the adjusting range of the tuning element is between the lower surface of the lid 105 and the plane represented by the upper part of the dielectric objects 111, 121. In this case, when the tuning element is insulated from the threading rod, the coupling becomes stronger when it is moved downwards, and vice versa. When the coupling strengthens, the resonance peaks of the resonator pair move away from each other, in which case the bandwidth increases.

A drawback of the solution described before is that the tuning of the bandwidth has been designed to be manual. The automatic tuning by using actuators is difficult to implement.

SUMMARY OF THE INVENTION

An object of the invention is to reduce said disadvantages related to prior art. The resonator filter according to advantageous embodiments of the invention is disclosed in the following detailed description.

One aspect of the invention is the following: In the partition wall separating the successive resonators on the transmission path of a resonator filter there is a coupling opening with typically constant width. The strength of the coupling between the resonators is adjusted by a tuning element which has been supported to the partition wall on the opposite sides of the coupling opening so that it can be moved. The tuning element is conductive and grounded so that the impedance between its ends and the partition wall is low. For moving the tuning element, it is linked by a dielectric rod to an electrically controllable actuator which is located on the filter lid.

An advantage of the invention is that the tuning of a filter can be automated, in other words the tuning can be done without laborious manual work. In this case the measurement device of the response is programmed so that it steers the actuators of the filter to move the tuning elements until the optimal response has been achieved. In addition, the invention has the advantage that in a filter according to it the grounding coupling of the tuning element can be implemented as capacitive, in which case the rise of the passive intermodulation is avoided in the adjusting mechanism because of the lack of metallic junctions. A further advantage of the invention is that a structure according to it enables a relatively large adjusting range for the strength of the coupling between the resonators and thus for the bandwidth of the filter.

BRIEF DESCRIPTION OF THE DRAWINGS

In the following, the invention will be described in detail. Reference will be made to the accompanying drawings, in which FIGS. 1*a,b* present an example of the prior art way to adjust the strength of the coupling between the filter's resonators.

DETAILED DESCRIPTION

Figure 1A:
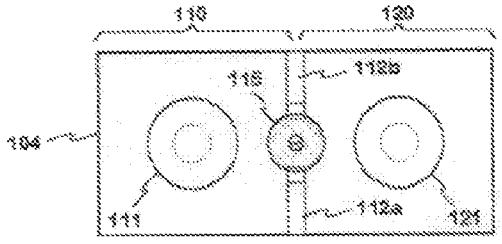
Fig. 1a PRIOR ART
Figure 1B:
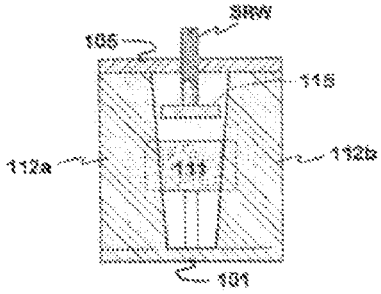
Fig. 1b PRIOR ART

FIGS. 1*a* and 1*b* were already explained in connection with the description of the prior art.

Figure 2:
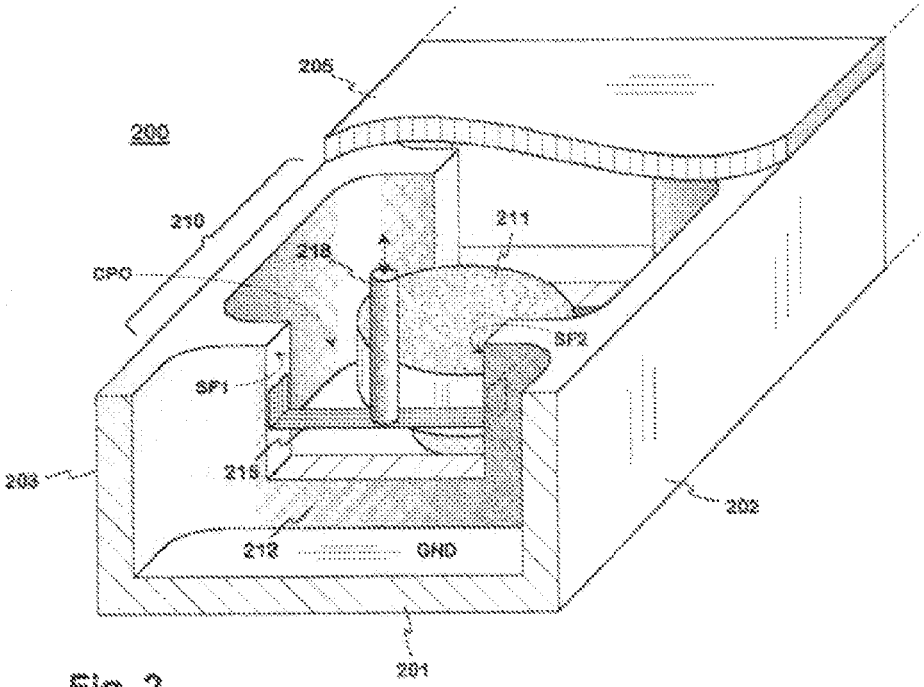
FIG. 2 presents an example of the tuneable filter according to the invention.

FIG. 2 shows an example of the tuneable filter according to the invention. The filter 200 comprises a conductive housing formed by a bottom 201, side walls 202, 203, head walls, and a lid 205. The space of the housing is divided into the resonator cavities by conductive partition walls 212 and in each partition wall separating two successive cavities there is a coupling opening CPO. In the drawing the filter has been truncated and the lid cut open so that only the cavity of a first resonator 210 is seen entirely, and the coupling opening between the first and second resonator is visible. When the filter is in use, its housing is a part of the signal ground GND of the transmission path.

In each resonator cavity there is a cylindrical dielectric resonator object for making the whole resonator smaller, such as the dielectric resonator object 211 of the first resonator 210. The bases of the cylinder are parallel with the bottom 201 and lid 205 of the filter, and it has been supported at a certain height from the filter's bottom by a dielectric support leg. The dielectric resonator objects have been dimensioned so that a $TE_{01}$ waveform is excited in them at the use frequencies of the filter. Thus, the resonators are half-wave cavity resonators by type, as in FIG. 1.

The coupling opening CPO in the partition wall 212 extends in this example from the lid 205 downwards past the halfway of the height line of the resonator cavities. In the coupling opening there is a tuning element 215 for adjusting the strength of the coupling between the first and second resonator. The tuning element is in this example a rigid metal strip, which extends horizontally across the coupling opening CPO from the first side wall SF1 to the second side wall SF2. The tuning element comprises a horizontal middle portion and vertical ends against the side walls of the coupling opening. It is in this way supported to said side walls. However, the friction between the ends of the tuning element and the side walls of the opening is so low that the tuning element can be slid in the vertical direction by a relatively low force. In order to make the vertical movement possible, the coupling opening has a constant width at least for the part of the designed adjusting range; here, the side walls of the opening are vertical. For moving the tuning element, a vertical control rod 218 has been fastened in its centre, which rod extends through the lid 205 above it. The rod is of dielectric material with low loss to keep the attenuation caused by the filter low.

The tuning element 215 has a significant electric coupling to the side walls of the opening CPO and through them to the signal ground GND. The coupling can be galvanic, but more preferably capacitive, because then the possible passive intermodulation in the boundaries of the tuning element and the partition wall 212 is avoided. In the case of the capacitive coupling there is a thin dielectric layer between the conductive part of the tuning element and the conductive side walls. The capacitance over it is arranged such that the absolute value of the impedance between an end of the tuning element and the partition wall at the use frequencies of the filter is for example 1Ω. Also higher values, such as 10-20Ω, are useful.

Thus the tuning element is grounded from its ends, in accordance with what has been described above. This results in that it reduces the effective size of the opening between the resonators. This means weakening of the coupling between the resonators compared to a case where the tuning element would be absent. On the contrary, without the grounding coupling a conductor between the resonator cavities would strengthen the coupling between the resonators. The grounded tuning element 215 weakens said coupling the most when it is located in the vertical direction about in the halfway of the dielectric resonator objects 211 in the cavities. When the tuning element is moved to either direction from that position, the coupling between the resonators becomes stronger. In the structure shown in FIG. 2 the adjusting range of the tuning element is upwards from the position, which corresponds to the minimum coupling. In principle, the opening could also be arranged so that the adjusting range would start downwards from the position which corresponds to the minimum coupling.

Figure 3:
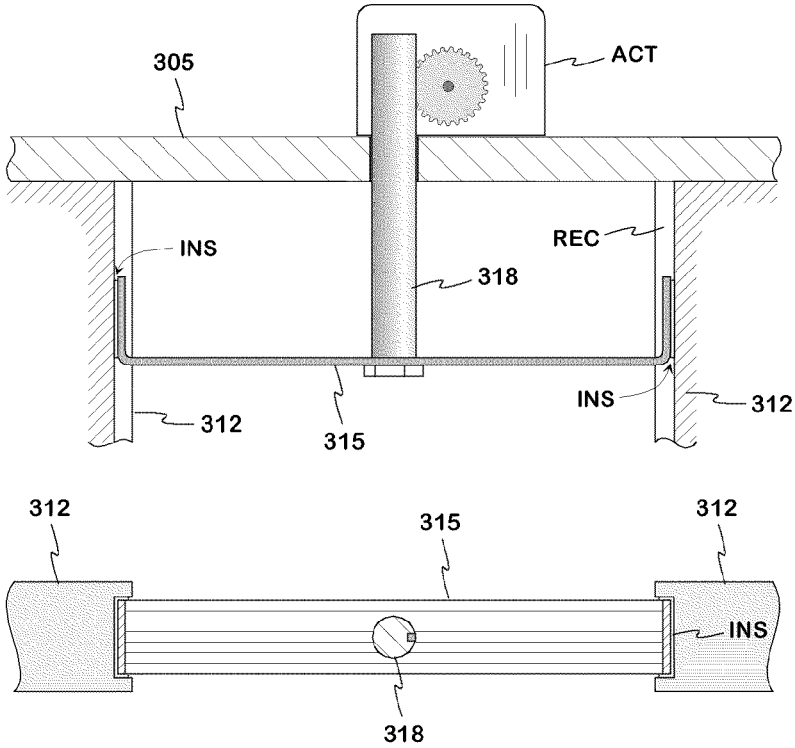
FIG. 3 presents an example of the tuning arrangement of a filter according to the invention.

FIG. 3 shows an example of the tuning arrangement of a filter according to the invention. The upper part of the figure presents the cross-section of the filter at the partition wall 312 of two resonators. In it, the tuning element 315 is seen from the side. In the lower part of FIG. 3 the tuning element is seen from above. The tuning element is like the one in FIG. 2 so that it comprises a rigid conductor strip between two side walls of a coupling opening in the partition wall 312 of two resonators. The ends of the conductor strip are bent, and these ends have been coated with an insulating layer INS to prevent a galvanic coupling to said partition wall. The thickness of the insulating layer is e.g. 0.1 mm. The conductor strip can be pre-bent to a little less than a right angle so that when the tuning element is mounted, its ends, turning to a right angle, press against the side walls of the coupling opening by a suitable spring force.

In this example there are vertical recesses REC in the side walls of the coupling opening, the width of the recesses is substantially the same as the width of the tuning element. The ends of the tuning element 315 are located in these recesses, which secures that the tuning element cannot turn horizontally when it is moved vertically. In this case said insulating layer of the tuning element coats, besides the outer surface of the vertical end of the conductor strip, also the narrow side surfaces of the conductor strip's end. The latter coating prevents a galvanic contact from developing to the side surfaces of the recesses REC.

In accordance with the matter described before, the tuning element 315 comprises a conductor strip and an insulating layer INS coating its ends. Alternatively, the tuning element could comprise only a conductor strip, and an insulating layer would be formed on the surfaces of the side walls of the coupling opening.

A vertical control rod 318, which extends above the lid 305 through a hole in it, has been fastened in the middle of the tuning element 315. An electrically controllable actuator ACT has been fastened to the upper surface of the lid, the control rod being attached to the mechanism of the actuator. In the example of FIG. 3 the actuator is a step motor, and a cogwheel on the shaft of the motor is located in the cog groove formed in the control rod. When a control pulse is given to the step motor, the cogwheel turns one step, and the control rod and the tuning element fastened to it move vertically a certain short distance. The rotation direction of the step motor can naturally be chosen. The actuator can also be for example a device based on the piezoelectricity which implements a linear movement. In this case its moving part is fixedly connected to the control rod 318.

Figure 4:
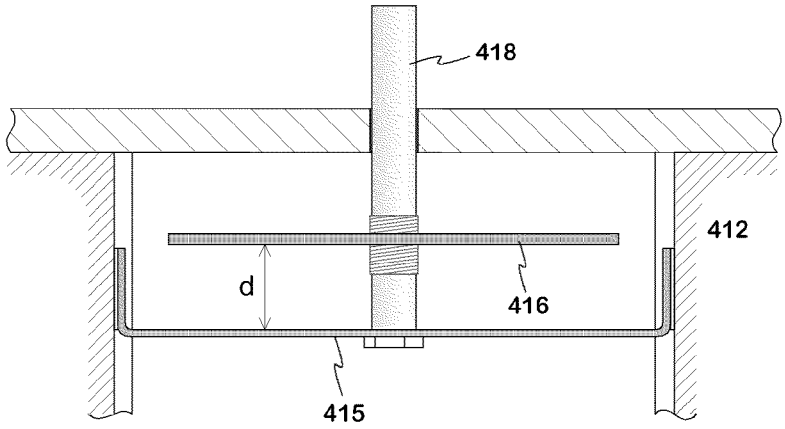
FIG. 4 presents another example of the tuning arrangement of a filter according to the invention.

FIG. 4 shows another example of the adjusting arrangement of a filter according to the invention. It comprises a tuning element 415, similar to the tuning element 315 seen in FIG. 3, fastened to the lower end of the control rod 418. In addition, the tuning arrangement comprises a conductor plate 416 fastened to the control rod 418 above the tuning element, which plate is here called a coupling element. The coupling element 416 strengthens the coupling between the resonators; it corresponds e.g. to the tuning element 115 seen in FIGS. 1*a* and 1*b*. The coupling between the resonators is at its maximum, when the coupling element 416 is located at the height of the middle level of the dielectric resonator objects in the cavities. When the control rod is raised from this position, both the movement of the tuning element 415 closer to said middle level and the movement of the coupling element 416 farther from the middle level weaken the coupling. The coupling element then functions as another tuning element extending the adjusting range of the coupling between the two resonators in question.

The width of the above-mentioned adjusting range can be controlled by changing the distance between the coupling element and the tuning element. In the structure according to FIG. 4 the changing the distance d takes place by rotating the coupling element 416 in the threads of the control rod 418. In this case the coupling element has to be a circle by shape. The coupling element also can be tightened e.g. between two nuts, in which case it can be i.a. a rectangle by shape.

Figure 5:
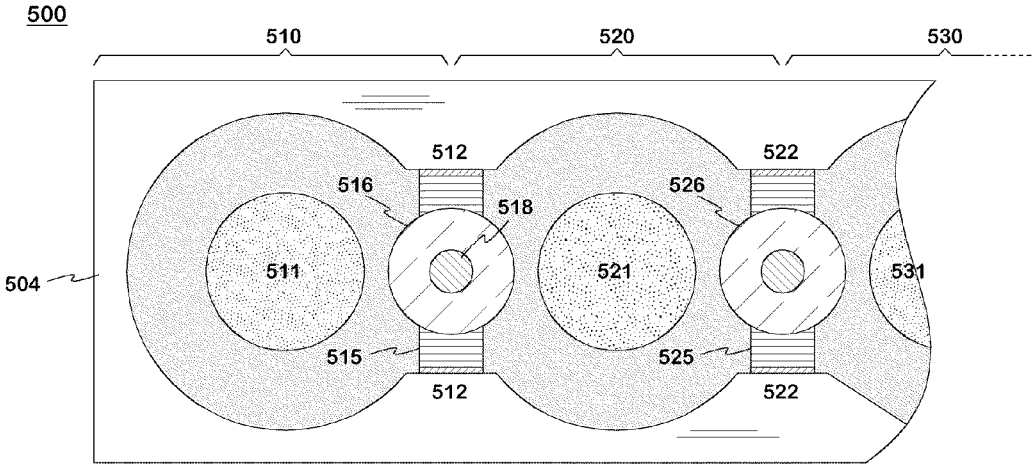
FIG. 5 presents a second example of the tuneable filter according to the invention.

FIG. 5 shows a second example of the tuneable filter according to the invention. The filter 500 is presented from above the lid and actuators removed. It comprises a conductive housing formed by a bottom, side walls, head walls 504 and a lid. The space of the housing is divided into resonator cavities by conductive partition walls 512, 522, which cavities are in this example cylindrical. In each partition wall there is a coupling opening. This can extend from the filter's lid to the bottom, in which case the partition wall consists of two projections of the side walls directed towards each other.

A first resonator 510, a second resonator 520, and a part of third resonator 530 of the filter are seen in FIG. 5. In the cavity of each resonator there is a cylindrical dielectric resonator object 511, 521, 531 like in the filter shown in FIG. 2.

The tuning arrangement in the filter 500 is in accordance with FIG. 4. So a vertical control rod 518 extends to the coupling opening between the first 510 and second 520 resonator, a tuning element 515 being fastened to the lower end of the control rod and a coupling element 516 above it. The tuning element is supported to the walls of the coupling opening electrically insulated from these walls, and the coupling element, which is here round, extends clearly to the resonator cavities but not quite close to the partition wall 512, or the walls of the coupling opening in it. There is a similar tuning arrangement with a tuning element 525 and coupling element 526 between the second and third resonator.

Figure 6:
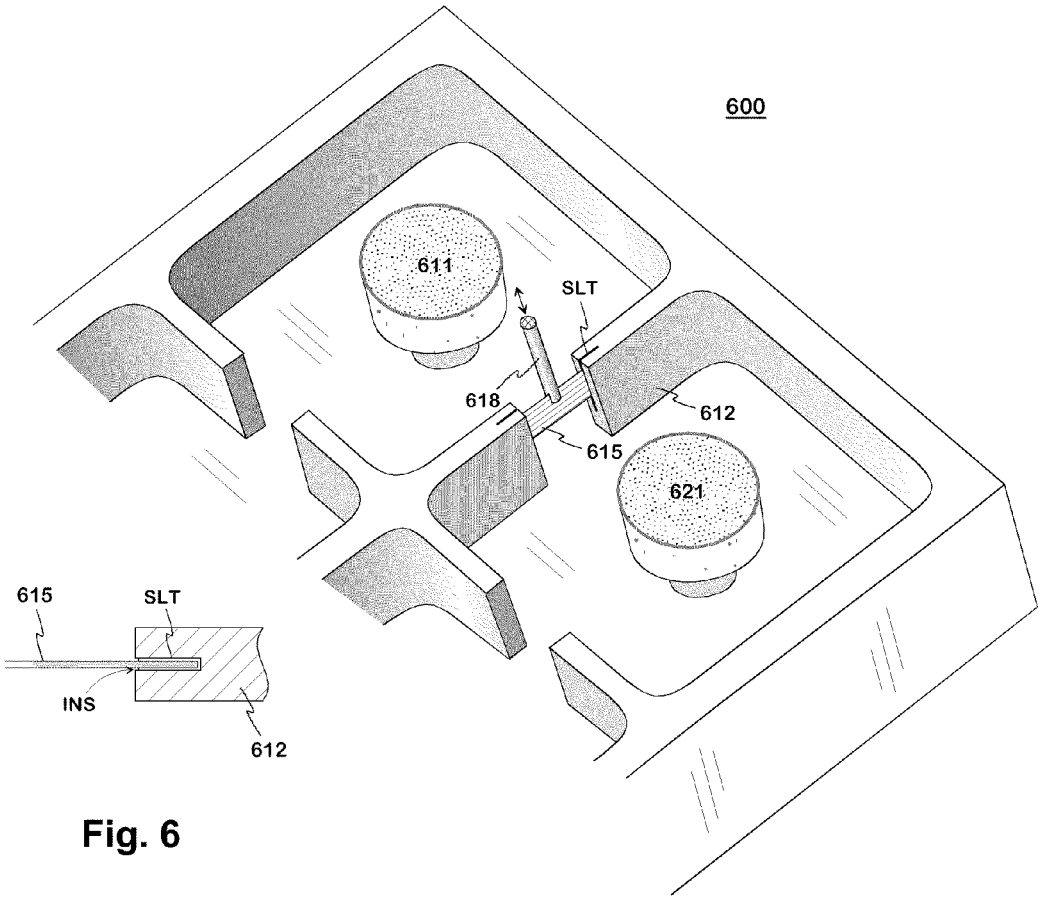
FIG. 6 presents a third example of the tuneable filter according to the invention, FIGS. 7*a,b* present a fourth example of the tuneable filter according to the invention.

FIG. 6 shows a third example of the tuneable filter according to the invention. The basic structure of the filter 600 is similar to the one in FIG. 2. In each resonator cavity there is then a dielectric resonator object supported between the lid and bottom of the filter housing, such as the resonator object 611 of a first resonator and the resonator object 621 of the second resonator next to the first one.

The tuning arrangement differs somewhat from the one shown in FIGS. 2 and 3. A vertically moveable tuning element 615 in the coupling opening of the partition wall 612 between the first and second resonator is seen in the figure. There is a slot SLT in the partition wall on both sides of the coupling opening, which slot starts in the vertical direction from the upper surface of the partition wall and in the horizontal direction from the side wall of the coupling opening. The slots extend in the vertical direction for example to the halfway of the partition wall and in the horizontal direction for example 10 mm deep. The tuning element 615 comprises a straight horizontal conductor strip, the ends of which are located in the slots SLT. Thus the transverse direction of the tuning element is vertical in this example. The conductor strip is insulated from the partition wall 612 on each side of the opening by a dielectric layer INS. This can be either of coating of the end of the conductor strip or coating of the slot in the partition wall. In both cases the thickness of the ends of the conductor strip is substantially the same as the width of the slot, so the tuning element is supported to the partition wall in the slots SLT.

The tuning element has been fastened to the vertical control rod 618 which again is attached to an actuator on the upper surface of the lid for moving the tuning element.

Figure 7A:
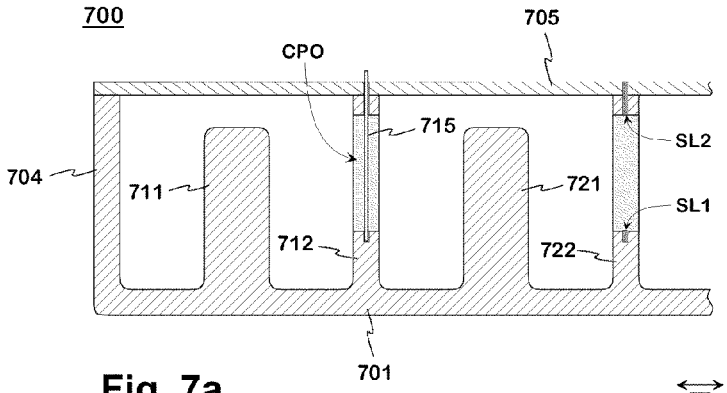
Figure 7B:
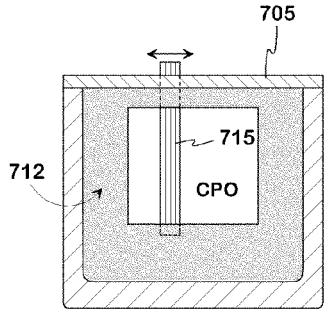

FIGS. 7*a* and 7*b* show a fourth example of the tuneable filter 700 according to the invention. It comprises a conductive housing formed by a bottom 701, side walls, head walls 704 and a lid 705, as in the previous examples. The resonators are in this example of coaxial type. This means that in each resonator cavity there is an inner conductor of the resonator which joins at its lower end galvanically the bottom 701. The inner conductors 711 and 712 of a first and second resonator are seen in the drawing. The outer conductor of the coaxial resonator consists of the parts of the housing and partition walls, which surround the inner conductor. The upper end of the inner conductors is in the air, which results in that the resonators are quarter-wave resonators, in other words the wavelength, which corresponds to their natural frequency, is four times the electric length of a resonator.

FIG. 7*a* shows the longitudinal section of the filter 700 in the geometric plane, which goes through the inner conductors, and FIG. 7*b* shows the cross section of the filter at the cavity of the first resonator, when the view is towards the second resonator.

Also in the filter 700 the coupling between the resonators takes place electromagnetically through an opening in their partition wall, and the strength of the coupling is adjusted by means of a moveable tuning element. In this example the tuning elements are vertical, and they are moved horizontally. For this reason there is in each partition wall a slot-like recess SL1 below the rectangular coupling opening and a corresponding slot SL2 above the coupling opening, which slot extends in the vertical direction from the coupling opening to the upper surface of the partition wall. In the horizontal direction both the recess SL1 and the slot SL2 extend for example from the line of one side wall of the coupling opening a little past the halfway of the coupling opening.

In both FIGS. 7*a* and 7*b* there is visible the tuning element 715 in the coupling opening CPO of said partition wall 712 between the first and second resonator. This element comprises a straight and rigid conductor strip, the lower end of which is located in the recess SL1 and the upper end in the slot SL2. The upper end continues as a control rod through a slot in the lid 705 at the slot SL2 above the lid in order to be attached to an actuator. The tuning element and the control rod can naturally be of one and the same object. The conductor strip of the tuning element is advantageously insulated from the partition wall 712 on both sides of the opening by a dielectric layer. This can be either of the coating of the conductor strip or the coating of the surface of the slots in the partition wall. The insulating layer is so thin that the tuning element will be grounded through the partition wall both below and above the coupling opening. The thickness of the ends of the tuning element is substantially same than the width of the slot/recess, so the tuning element is supported to the partition wall in them.

The height of the coupling opening can also be the same as the height of the resonator cavity. In this case the recess SL1 is in the bottom of the filter housing and the slot in the lid corresponds to said slot SL2. The parts of the lid and bottom at the partition wall are understood in this special case to belong to the partition wall.

The coupling between the coaxial resonators is at its minimum, when the grounded and vertical coupling element 715 is located in the middle of the coupling opening CPO. Correspondingly, the coupling becomes stronger when the tuning element is moved towards a side of the coupling opening.

Figure 8:
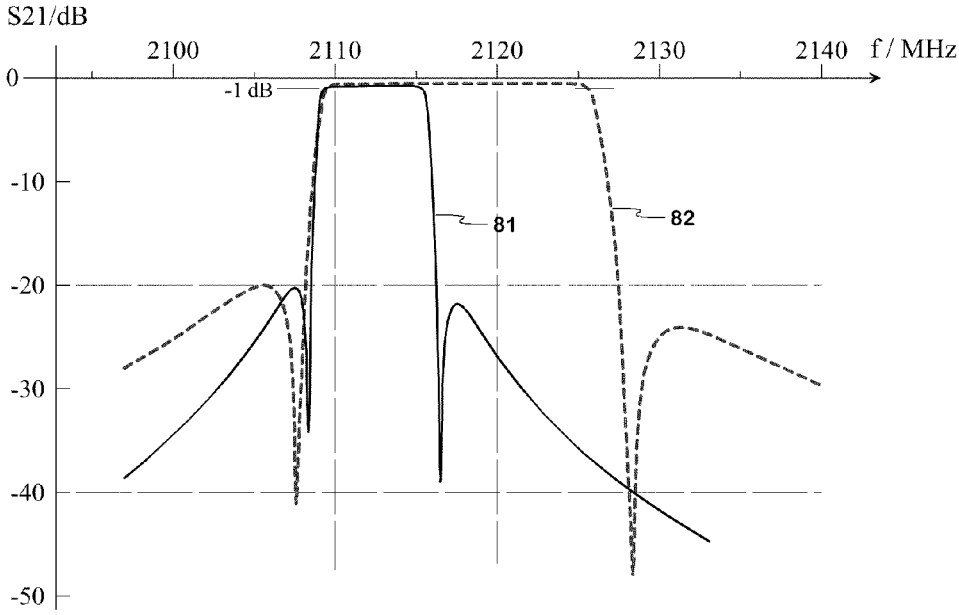
FIG. 8 presents an example of the adjustment of the filter's bandwidth, implemented by a tuning arrangement according to the invention.

FIG. 8 shows an example of the adjustment of the filter's bandwidth, implemented by a tuning arrangement according to the invention. A filter with six resonators, like the one in FIG. 5, is in question. In the figure there is the transmission coefficient S21 as a function of frequency, i.e. the amplitude response, in two situations. Curve 81 shows the response, when the width of the filter's passband has been set to about 5 MHz, and curve 82 shows the response, when the width of the passband has been set to about 15 MHz. In both cases the passband has been arranged, by adjusting the natural frequency, to start from about the frequency 2110 MHz, or the lower boundary of the frequency range used by the traffic directed down from the base stations in the WCDMA system (Wideband Code Division Multiple Access).

The widening of the passband takes place by increasing the strength of the coupling between the resonators (and also the strength of the coupling in the input and output of the filter). The widening of the band is based on the fact that when the coupling strengthens, the resonance peaks of a double resonance move away from each other. In manufacturing stage the passband filter is in principle dimensioned so that the coupling strength between the middle resonators, in this example the third and fourth resonators, is the lowest, and the coupling strength increases from the middle towards the ends of the filter. When the band is widened, all couplings are strengthened by about the same amount. In the example of FIG. 8 the coupling coefficients are increased in proportion 2.7-2.8 depending a little on which interpoint is in question.

The qualifiers 'horizontal', 'vertical', 'lower', 'upper', 'downwards', 'upwards' and 'from above' refer in this description and the claims to a position of the filter in which the lid and bottom of the filter housing are horizontal, the lid above, and these qualifiers have nothing to do with the use position of the filter.

A tuneable resonator filter has been described above. Its tuning mechanism can naturally differ in detail from the ones presented. For example, the shape of the tuning element and the shape of the control rod can vary. The control rod can be also conductive at some part, as long as the tuning element and the possible coupling element are fastened to its dielectric part. The tuning element can be supported to the side walls of the coupling opening or the surfaces of the slots in the partition wall regardless of the resonator type. The movement of the tuning elements can be implemented also by using one shared actuator by means of a mechanism which extends to the control rods of different tuning elements from the actuator. The invention does not limit the manufacturing way of the resonators or their tuning elements. The inventive idea can be applied in different ways.

The invention claimed is:

1. A resonator filter comprising:

a conductive housing having a bottom, walls, and a lid, a space of which housing is divided into resonator cavities by conductive partition walls, and in each of the conductive partition walls separating two successive ones of the resonator cavities on a transmission path there is a coupling opening (CPO) to excite an oscillation in a latter one of the two successive resonator cavities, wherein the CPO has side walls and in which CPO there is a movable tuning element having an adjusting range within which to adjust the strength of coupling between the successive resonator cavities and thus the bandwidth of the resonator filter and each tuning element includes a conductive part and is grounded with a grounding coupling to that conductive partition wall within which it is located, wherein the tuning element in the CPO is supported to that partition wall on opposite sides of the side walls of the CPO each of the tuning elements is fastened to a control rod, which extends above the lid of the conductive housing of the resonator filter and which control rod is mechanically connected to an electrically controllable actuator to move the tuning element in its adjusting range, and each of the turning elements includes a dielectric layer between the conductive part of the tuning element and a conductive part of that conductive partition wall within which the tuning element is located.

2. The resonator filter according to claim 1, wherein the grounding coupling of the tuning element is capacitive.

3. The resonator filter according to claim 1, wherein the resonator cavities are dielectric cavity resonators, each of which comprises a dielectric resonator object supported to the bottom of the conductive housing, and each of the tuning elements extends horizontally across the CPO being then supported to said conductive partition wall associated with that tuning element on a side of the side walls of the CPO, and said adjusting range of each of the tuning elements starts upward or downward from a height of a middle level of the dielectric resonator object, and said control rod is dielectric at least at an end thereof which is fastened to the particular tuning element to which said control rod is fastened.

4. The resonator filter according to claim 3, wherein each CPO has at least at a certain vertical distance, a constant width, and each of the tuning elements comprises a rigid conductor strip with a horizontal middle portion and vertical ends supported to two of the side walls of the CPO.

5. The resonator filter according to claim 4, wherein in the side walls of the CPO there are recesses, the widths of which are substantially the same as a width of the tuning element retained therein, and the vertical ends of each of the tuning elements are located in these recesses to prevent a horizontal turning of any of the tuning elements when moved vertically.

6. The resonator filter according to claim 3, further comprising a conductive coupling element fastened to said control rod above the tuning element to which that control rod is listened to widen the adjusting range of the coupling between the two successive resonator cavities.

7. The resonator filter according to claim 6, wherein a vertical distance (d) between any of the toning elements and the coupling element associated therewith is changeable to control a width of said adjusting range.

8. The resonator filter according to claim 1, wherein the electrically controllable actuator is located on an upper surface of the lid.

* * * * *